US010005051B2

(12) United States Patent
Paz

(10) Patent No.: US 10,005,051 B2
(45) **Date of Patent: *Jun. 26, 2018**

(54) VACUUM PUG MILL

(71) Applicant: Jared Paz, Uklah, CA (US)

(72) Inventor: Jared Paz, Uklah, CA (US)

( * ) Notice: Subject to any disclaimer, the term of this patent is extended or adjusted under 35 U.S.C. 154(b) by 2 days.

This patent is subject to a terminal disclaimer.

(21) Appl. No.: 15/261,638

(22) Filed: Sep. 9, 2016

(65) Prior Publication Data

US 2017/0001158 A1 Jan. 5, 2017

Related U.S. Application Data

(63) Continuation of application No. 14/534,672, filed on Nov. 6, 2014, now Pat. No. 9,475,018.

(51) Int. Cl.

| | |
|---|---|
| ***B01F 13/06*** | (2006.01) |
| ***B01F 7/00*** | (2006.01) |
| ***B01F 7/04*** | (2006.01) |
| ***B01F 3/12*** | (2006.01) |
| ***B01F 7/08*** | (2006.01) |
| ***B28B 17/02*** | (2006.01) |
| ***B28C 1/16*** | (2006.01) |
| ***B28C 1/22*** | (2006.01) |
| ***B28C 5/14*** | (2006.01) |
| *B01F 15/00* | (2006.01) |

(52) U.S. Cl.

CPC ..... *B01F 13/06* (2013.01); *B01F 3/1221* (2013.01); *B01F 7/0065* (2013.01); *B01F 7/00133* (2013.01); *B01F 7/00158* (2013.01); *B01F 7/00416* (2013.01); *B01F 7/00708* (2013.01); *B01F 7/04* (2013.01); *B01F 7/08* (2013.01); *B28B 17/02* (2013.01); *B28C 1/16* (2013.01); *B28C 1/225* (2013.01); *B28C 5/143* (2013.01); *B01F 2015/00084* (2013.01); *B01F 2015/00642* (2013.01); *B01F 2215/0047* (2013.01)

(58) Field of Classification Search

CPC ..... B01F 13/06
USPC ..... 366/75, 99, 139; 425/203
See application file for complete search history.

(56) References Cited

U.S. PATENT DOCUMENTS

| | | | | |
|---|---|---|---|---|
| 338,121 A | | 3/1886 | Wallace | |
| 842,206 A | | 1/1907 | Lowry | |
| 2,078,565 A | * | 4/1937 | Durst | A23G 3/0226 100/90 |
| 2,572,063 A | * | 10/1951 | Skipper | B28B 3/22 159/2.2 |
| 2,758,855 A | | 8/1956 | Russell | |

(Continued)

*Primary Examiner* — Abbas Rashid
(74) *Attorney, Agent, or Firm* — Karish & Bjorgum, PC

(57) ABSTRACT

A pug mill having a housing and a cantilevered shaft extending through the housing includes, in seriatim, a vacuum chamber, a wall, a mixing chamber and a reduction cone. A communication port about the shaft is positioned in the wall between the vacuum chamber and the mixing chamber. Vacuum can be maintained within the mixing chamber by air passing through the port. An auger associated with the shaft forces clay toward the reduction cone. This creates a seal for maintaining vacuum within the mixing chamber and extrudes cylindrical blocks of conditioned clay without significant air bubbles. A deflection plate rotating with the shaft and a spiral element about the shaft keep the communication port clear. The shaft is eccentrically mounted. The dividing wall is removable.

7 Claims, 4 Drawing Sheets

(56) References Cited

U.S. PATENT DOCUMENTS

| | | | |
|---|---|---|---|
| 2,868,144 | A | 1/1959 | Ambrette |
| 3,145,977 | A | 8/1964 | August |
| 3,180,628 | A | 4/1965 | Pullin |
| 3,323,570 | A | 6/1967 | Tullock |
| 3,493,031 | A | 2/1970 | Williams, Jr. et al. |
| 3,548,903 | A | 12/1970 | Holly |
| 3,606,277 | A | 9/1971 | Kader |
| 3,932,086 | A | 1/1976 | Kasamatsu |
| 3,946,996 | A | 3/1976 | Gergely |
| 4,097,926 | A | 6/1978 | Face |
| 4,322,169 | A | 3/1982 | Wood |
| 4,382,404 | A | 5/1983 | Hawley et al. |
| 5,106,198 | A | 4/1992 | Muller |
| 5,716,130 | A | 2/1998 | Wood |
| 9,016,927 | B2 | 4/2015 | Kuriki |

* cited by examiner

VACUUM PUG MILL

CROSS-REFERENCE TO RELATED APPLICATIONS

This is a continuation of U.S. patent application Ser. No. 14/534,672, filed Nov. 6, 2014, the disclosure of which is incorporated herein by reference.

BACKGROUND OF THE INVENTION

The field of the present invention is pug mills for mixing and conditioning clay for ceramics.

Pug mills are designed for producing clay conditioned for the manufacture of ceramics. The mills typically are used to mix clay powder and water or rehydrate, remix and/or recondition existing clay. Powders and water may also be mixed with existing clay to form a homogeneous product. The clay, once mixed, is most conveniently extruded through a reduction cone to form cylindrical or rectangular blocks also known as pugs.

Pug mills upon which the present design is based are disclosed in U.S. Pat. No. 4,322,169 entitled CLAY MIXING APPARATUS and U.S. Pat. No. 5,716,130 entitled VACUUM PUG MILL, the disclosures of which are incorporated herein by reference in their entirety. These pug mills include a mixing chamber expending to an extruder in communication therewith. A shaft is rotatably mounted relative to the mixing chamber and the extruder. Mixing blades associated with the mixing chamber are fixed to the shaft as is an auger associated with the extruder. The shaft is rotatably mounted by bearings such that an extension of the shaft through the mixing chamber and the extruder is cantilevered from the bearings. The bearings are positioned in a housing including a drive motor and drive train for forcibly rotating the shaft. The shaft is rotatable in either direction about its axis. When rotated in a first direction, mixing takes place. When rotated in a second direction, the clay is advanced by the mixing blades and by the auger for extrusion through the reduction cone.

In addition to the conditioning of clay to achieve an appropriate moisture content and homogeneity, it is advantageous to remove as much air as possible. Air entrapped in the clay when fired can expand to ruin the article manufactured. Also, entrapped air can adversely affect throwing operations as it makes the clay "short" and hard to work with. The pug mill disclosed in U.S. Pat. No. 5,716,130 provides a vacuum chamber in communication with the mixing chamber for drawing a vacuum on the clay to remove air from being mixed into the clay. A cover on the end of the reduction cone or a solid body of clay being extruded therefrom provides a sealed mixing chamber to permit the drawing of the vacuum.

U.S. Pat. No. 5,716,130 provides a mechanism for maintaining a clear communication port between the mixing chamber and the vacuum chamber of that mill. It remains that material being pugged can still overwhelm the communication port and interrupt the application of vacuum in the mixing chamber.

SUMMARY OF THE INVENTION

The present invention is directed to a pug mill which provides for vacuum associated with the mixing process with enhanced communication of vacuum from the mixing chamber to the vacuum chamber.

The pug mill includes a mixing chamber and a vacuum chamber with a wall therebetween. The wall includes a communication port between the mixing chamber and the vacuum chamber. The chambers each include a housing. The housings mate together with the wall being removable for critical accommodation of various mixing materials.

Therefore, it is a principal object of the present invention to provide an improved vacuum pug mill. Other and further objects and advantages will appear hereinafter.

DETAILED DESCRIPTION OF THE PREFERRED EMBODIMENT

Figure 1:
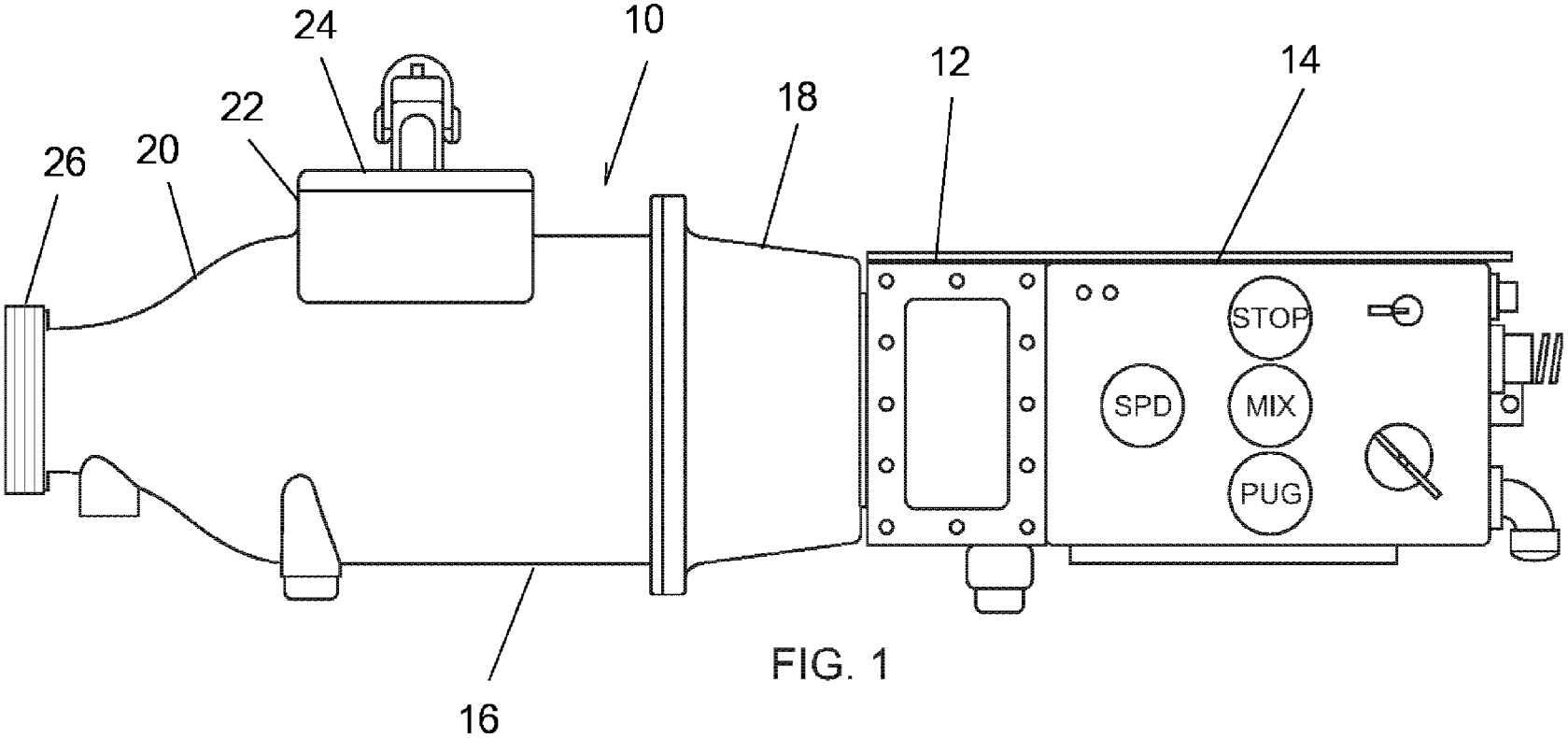
FIG. 1 is an elevation of a pug mill.
Figure 2:
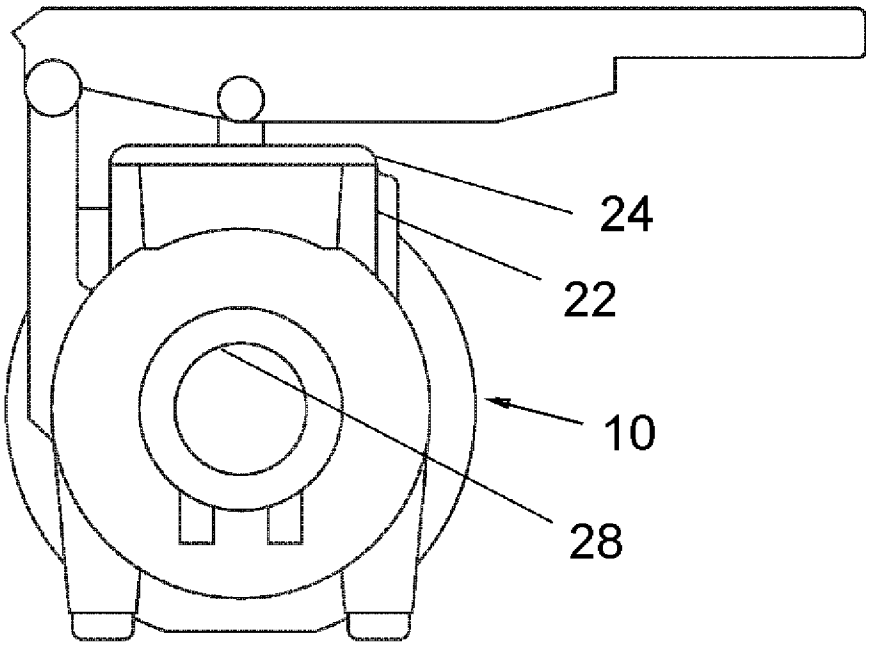
FIG. 2 is an end view of the pug mill of FIG. 1.
Figure 5:
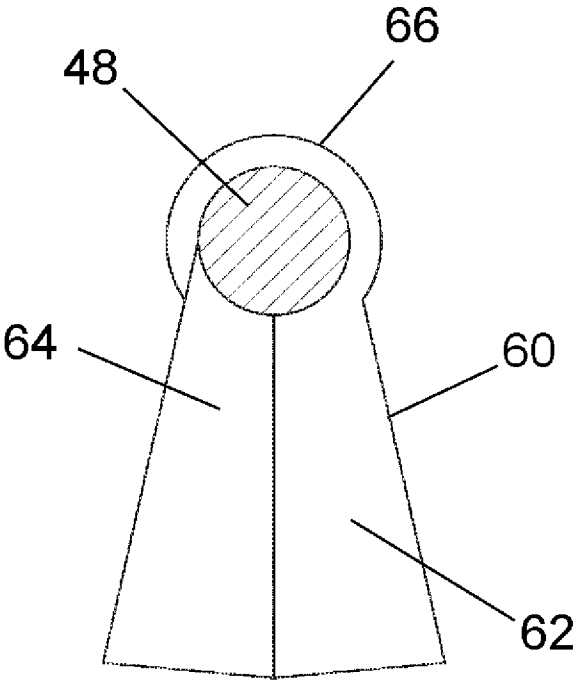
FIG. 5 is a front view of the deflection plate on the shaft of the pug mill.

Turning in detail to the drawings, a pug mill is illustrated in FIGS. 1 and 2. The assembly includes a sealable chamber housing assembly 10, a gear casing 12 and a power box 14. The housing assembly 10 encloses a sealable chamber defined by a mixing chamber housing 16 and a vacuum chamber housing 18. The mixing chamber housing 16 includes a reduction cone 20 at the end of the housing 16, an access port 22 and a hatch cover 24 for access to the interior of the sealable chamber. A cover 26 covers an extrusion port 28 at the end of the reduction cone 20 for selectively sealing the sealable chamber. The gear casing 12 and power box 14 provide controls, a drive motor and gearing for driving a shaft extending through the vacuum chamber housing 18 and mixing chamber housing 16. A source of vacuum (not illustrated) is provided in communication with the vacuum chamber housing 18 through the power box 14 as well. The vacuum chamber housing 18 also includes an access port and cover to allow cleaning out of any clay material which may accumulate in the chamber.

Figure 3:
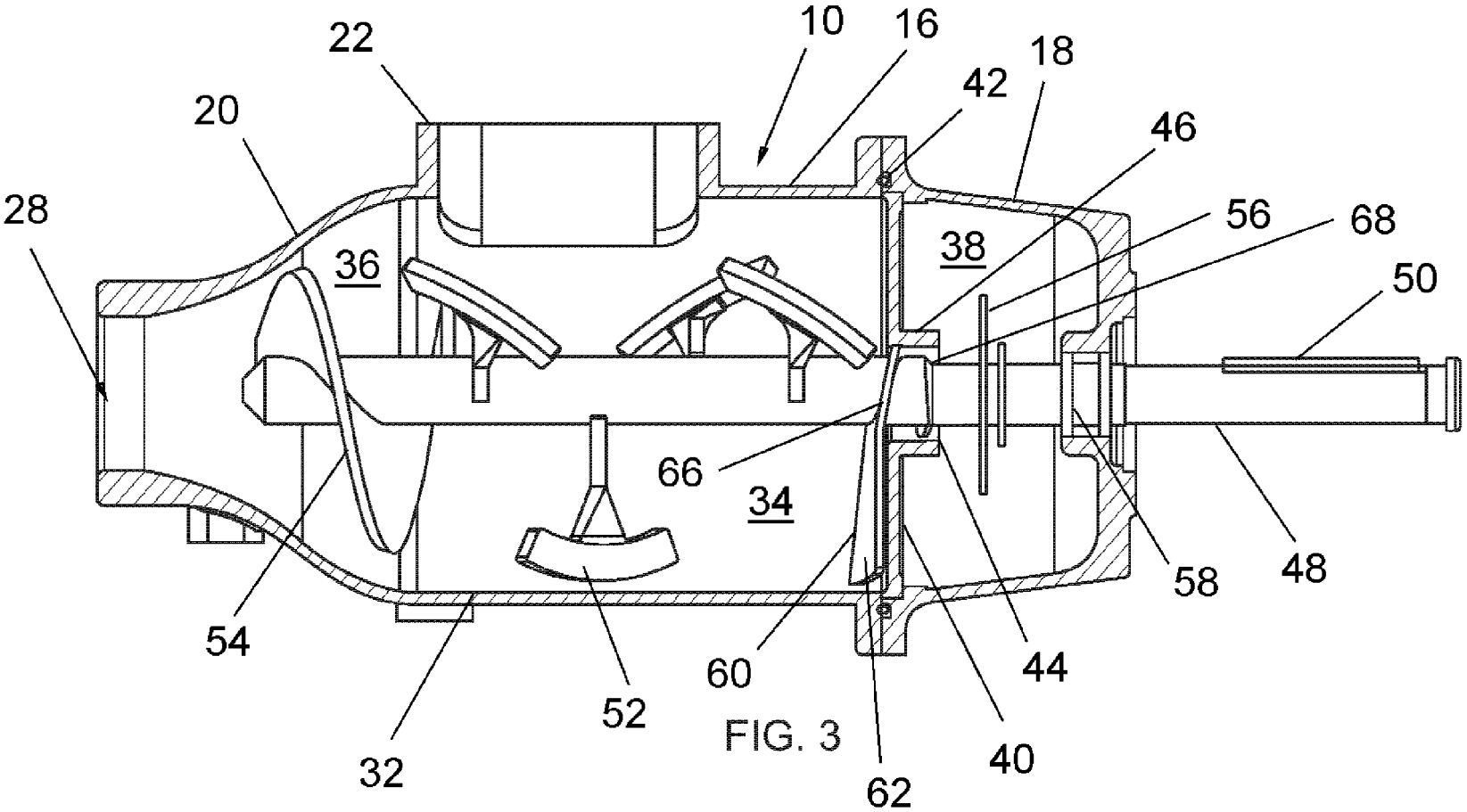
FIG. 3 is a cross-sectional elevation at the center plane of the pug mill of FIG. 1.
Figure 4:
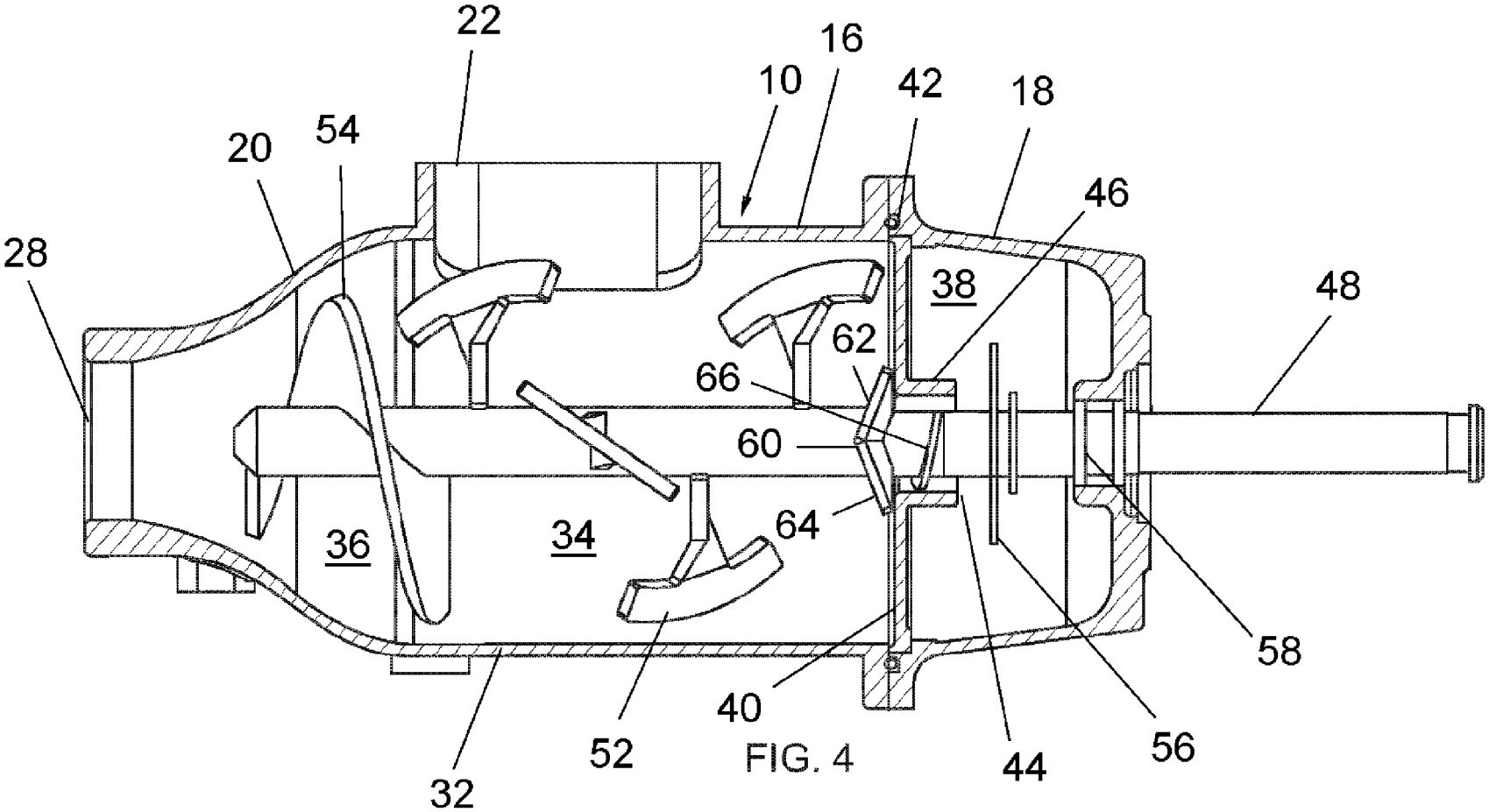
FIG. 4 is a cross-sectional elevation at the center plane of the pug mill of FIG. 1 with the shaft rotated 90° from the position shown in FIG. 3.

Turning to FIGS. 3 and 4, a mixing chamber 32 is revealed within the mixing chamber housing 16. This chamber 32 includes a mixing zone 34 and an auger zone 36. The mixing zone 34 is generally cylindrical while the auger zone 36 includes the reduction cone 20 leading to the extrusion port 28. The vacuum chamber housing 18 is revealed in FIGS. 3 and 4 to include a vacuum chamber 38.

A wall 40 is located between the mating housings 16 and 18. In the embodiment illustrated, the wall 40 is positioned in a channel cut into the mating face of the vacuum chamber housing 18 and held in place by the abutting mixing chamber housing 16. A seal 42 is located outwardly of the wall 40 between the mating flanges of the mixing chamber housing 16 and the vacuum chamber housing 18. The wall 40 may also be retained in this position through attachment to one or the other of the housings 16, 18. The wall 40 divides the sealable chamber between the mixing chamber 32 and the vacuum chamber 38 and includes a communication port 44 therethrough to provide vacuum throughout the sealable chamber. A cylindrical flange 46 extends the communication port into the interior of the vacuum chamber 38.

A shaft 48 is rotatably mounted to the closed end of the vacuum chamber housing 18 as well as in the gear casing 12 to extend through the vacuum chamber 38 and the mixing chamber 32 to the reduction cone 20. The shaft 48 includes a key 50 to couple with a hollow shaft gear within the gear casing 12. The shaft 48 is powered by a motor (not illustrated) through the gear casing 12 and can be controlled to be driven in either direction. Mixing paddles 52 are attached to the shaft 48 so as to be located in the mixing chamber 32. A wide range of such paddle configurations and placements may be employed. The flight of an auger 54 is located at the end of the cantilevered shaft 48 to reside within the auger zone 36. A deflection disc 56 extends radially about the shaft 48 within the vacuum chamber 38 to define a barrier to prevent clay material from moving along the shaft to the seal bearings 58. The deflector disc 56 is shown displaced from both the wall 40 and the seal bearings 58.

A deflection plate 60 is also fixed to the shaft 48. The location of the deflection plate 60 on the shaft 48 places the deflection plate immediately adjacent the wall 40 on the mixing chamber side. It is preferable that the deflection plate 60 be as close as practical to the wall 40 and yet not touch the wall as the shaft 48 rotates. The deflection plate 60 extends radially outwardly from the shaft 48 beyond the extent of the communication port 44. The deflection plate 60 includes two deflection surfaces 62, 64 facing the mixing chamber 32. These surfaces 62, 64 each extend at a shallow incline away from the adjacent wall 40 to meet at a central radial apex. A spiral element 66 affixed to the shaft 48 extends from the deflection plate 60 through the communication port 44. Sufficient clearance for air to pass through the communication port 44 about the shaft 48 and spiral element 66 is also provided.

The pug mill operates by controlling the rotational direction of the shaft 48. With the shaft rotating in one direction, the mixing paddles 52 and the auger 54 urge the clay material within the mixing chamber 32 toward the wall 40 so as to remain in the mixing chamber 32. When the rotation of the shaft 48 is reversed, the mixing paddles 52 and the auger 54 advance the clay material away from the wall 40 through the reduction cone 20 and the extrusion port 28.

With the rotation of the deflection plate 60, the leading deflection surface 62 resists the movement of the advancing clay material toward the communication port 14 with the mill in the mixing mode. The other deflection surface 64 also urges the clay material away from the communication port 44 with the shaft rotating in the other direction in the extrusion mode. The spiral element 66 spirals in the opposite direction from the flight of the auger 54 and the inclination of the mixing paddles 52. The spiral element 66 thus advances clay material entering the communication port 44 back toward the mixing chamber 32 when the mixing paddles 52 and the flight of the auger 54 are moving the clay material toward the communication port 14. With the shaft 48 rotating in the opposite direction, the mixed material moves toward the extrusion port 28 away from the wall 40, providing relief to the spiral element 66 which is then rotating in a way which would urge clay material to move into the vacuum chamber 38. During operation with the vacuum source actuated, it has been found that a cycling of the shaft 48 through rotation in both directions can assist in keeping the mixed material away from the communication port 44.

In the preferred embodiment, the shaft 48 is also eccentric to the rotational axis at least in the area of the mixing chamber 32. The shaft 48 is shown to be displaced laterally from that axis at position 68 by a small amount. Clearance is provided for the spiral element 66, the mixing paddles 52 and the auger 54 within the sealable chamber to accommodate the eccentricity. By eccentric rotation of the shaft 48, a pathway may be generated along the shaft 48 for the extraction of air from the body of clay material being mixed.

Thus, a pug mill with improved air extraction is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A pug mill comprising a mixing chamber housing;

a vacuum chamber housing, the mixing chamber housing and the vacuum chamber housing including a mutual annular abutment to define a sealable chamber, an annular channel about the sealable chamber at the mutual annular abutment between the mixing chamber housing and the vacuum chamber housing;

a wall in the sealable chamber dividing the sealable chamber into a mixing chamber and a vacuum chamber, the wall including a communication port therethrough in communication with the mixing chamber and the vacuum chamber, the wall extending into and being retained by the annular channel with the mixing chamber housing and the vacuum chamber housing mutually abutting;

an auger drive shaft rotatable in the sealable chamber about a rotational axis and extending through the communication port.

2. The pug mill of claim 1, the annular channel being in the vacuum chamber housing at the mutual annular abutment and closed on one side by the mixing chamber housing at the mutual annular abutment.

3. The pug mill of claim 2 further comprising a seal extending around the mutual annular abutment between the mixing chamber housing and the vacuum chamber housing and being radially outwardly of the channel.

4. The pug mill of claim 1, the auger drive shaft including an auger integral therewith.

5. The pug mill of claim 4, the auger drive shaft being eccentric to the rotational axis in the sealable chamber.

6. The pug mill of claim 4, the mixing chamber housing including a reduction cone displaced from the wall, the shaft including mixing paddles in the mixing chamber housing and an auger extending into the reduction cone.

7. The pug mill of claim 1, the auger drive shaft further including a deflection plate fixed to the shaft immediately adjacent the wall in the mixing chamber housing.

* * * * *